US007737217B2

(12) United States Patent
Kauppi et al.

(10) Patent No.: US 7,737,217 B2
(45) Date of Patent: Jun. 15, 2010

(54) METHOD OF MAKING CEMENTED CARBIDE OR CERMET AGGLOMERATED POWDER MIXTURES

(75) Inventors: Annika Kauppi, Hässelby (SE); Ulf Jutterström, Stockholm (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 11/802,925

(22) Filed: May 25, 2007

(65) Prior Publication Data

US 2007/0282068 A1 Dec. 6, 2007

(30) Foreign Application Priority Data

May 31, 2006 (SE) ..... 0601195

(51) Int. Cl.

| | |
|---|---|
| ***C08L 9/00*** | (2006.01) |
| ***C08F 118/02*** | (2006.01) |
| ***C08F 20/06*** | (2006.01) |
| ***C08F 12/02*** | (2006.01) |
| ***C08F 24/00*** | (2006.01) |

(52) U.S. Cl. ..... 525/98; 526/319; 526/317.1; 526/346; 526/266

(58) Field of Classification Search ..... 525/98; 526/319, 317.1, 346, 266

See application file for complete search history.

(56) References Cited

U.S. PATENT DOCUMENTS 6,559,236 B1 * 5/2003 Willimann et al. ..... 525/293
6,632,883 B2 10/2003 Mayes et al.
6,878,182 B2 * 4/2005 Kruse ..... 75/252
2006/0286378 A1 * 12/2006 Chiruvolu et al. ..... 428/402
2007/0073000 A1 * 3/2007 Mayes et al. ..... 525/191

OTHER PUBLICATIONS

Gonzalez-Leon, J. A. et al., "Core-Shell Polymer Nanoparticles for Baroplastic Processing", Macromolecules, 38 (2005), pp. 8036-8044.

Gonzalez-Leon, J. A. et al., "Low-temperature processing of 'baroplastics' by pressure-induced flow", Nature, vol. 426 (2003), pp. 424-428.

Erik Lassner et al., "Tungsten—Properties, Chemistry, Technology of the Element, Alloys, and Chemical Compounds", (1999), New York: Kluwer Academic/Plenum Publishers, pp. 321-363 (1999).

* cited by examiner

*Primary Examiner*—William K Cheung
(74) *Attorney, Agent, or Firm*—Drinker Biddle & Reath LLP

(57) ABSTRACT

The present invention relates to a method of making a ready-to-press agglomerated powder mixture by wet milling a powder mixture containing binder and spray drying said slurry to an agglomerated powder useful for making cutting tools for metal machining, tools for rock drilling and wear parts. If the binder is a baroplastic polymer having a pressure induced transformation from hard to soft well developed agglomerates with good flow properties and good plasticity are obtained. The hard property of the binder is used at normal pressures, during handling of the spray-dried powder and in the green body, whereas the softer properties are used at higher pressures during the pressing of the material when the pressure exceeds from about 10 to about 50 MPa.

10 Claims, 3 Drawing Sheets

METHOD OF MAKING CEMENTED CARBIDE OR CERMET AGGLOMERATED POWDER MIXTURES

BACKGROUND OF THE INVENTION

The present invention relates to a method of making agglomerated cemented carbide, cermet or ceramic powder mixtures useful for making cutting tools for metal machining, tools for rock drilling and wear parts.

Cemented carbide or cermet alloys are made of hard constituents from about 5 to about 20 vol-% metal binder phase essentially based on Co and/or Ni. In cemented carbides, the hard constituent is generally carbides whereas in cermets they are nitrides and/or carbonitrides and possibly carbides.

Cemented carbide or cermet bodies are made by powder metallurgical methods of wet milling a powder mixture containing powders forming the hard constituents and binder phase as well as binders and other additives often of a proprietary nature, drying the milled mixture to a ready-to-press powder with good flow properties, pressing the powder in press tools or extruding to bodies of desired shape and finally sintering.

The milling operation produces a slurry which is suitable for subsequent drying. The drying can be performed by spray drying or freeze granulation followed by freeze drying. As a result of the drying process spherical agglomerates of about 0.1 mm diameter are obtained held together by the binder, generally Poly Ethylene Glycol, PEG. This PEG binder is present during pressing but is ultimately removed during sintering.

It is important that the agglomerates have good flow properties to allow an even filling of the press tool and to allow redistribution thereof in the initial phase of the compaction. This is generally obtained by choosing hard agglomerates. Such agglomerates are obtained by using PEG with a high molecular weight. This often leads to porosity problems in the final sintered body. At a certain point in the compaction operation, soft agglomerates are desired in order to secure an even and homogeneous density in the pressed body. This can be obtained by using a PEG with low molecular weight. This gives a pressed body with low porosity but with a less than even density distribution due to the inferior flow properties. When high molecular weight and low molecular weight PEG polymers are blended, a compromise can be achieved, but it is not optimal neither regarding the flow properties nor the density variations in the green body. Optimal would be a binder that has hard properties during the handling of the granules, the filling of the mold and in the green body, but soft properties during the pressing of the material.

Baroplastic is a novel class of materials which is a block copolymer composition capable of being processed by the application of pressure. It is a core-shell polymer of particles with a core of a polymer with soft properties, and a shell of a polymer with hard properties with the size of the particles in the range of from about 50 to about 200 nm. During normal pressure, the core and the shell polymers are not miscible, and hence they stay separate, as core and shell. However, the miscibility of the polymers increases with increasing pressure, and at high pressures the polymers are mixed and get properties in-between the soft core and the hard shell. The increased miscibility at high pressures is reversible, and on lowering the pressure the polymers form a core-shell structure again.

In "Low-temperature processing of "baroplastics" by pressure-induced flow" by J. A. Gonzalez-Leon, M. H. Acar, S.-W. Ryu, A.-V. G. Ruzette and A. Mayes, Nature vol. 426, 424-428, 2003, a process for manufacturing baroplastic polymers are disclosed. The baroplastic polymers obtained low-temperature formability at ambient temperature and could be remolded without degradation.

In "Core-shell polymer nanoparticles for baroplastic processing" by J. A. Gonzalez-Leon, S.-W. Ryu,S. A. Hewlett, S. H. Ibrahim and A. Mayes, Macromolecules, vol 38, 8036-8044, 2005, the properties of baroplastic polymers are further investigated. Especially, the impact of composition, particle size and structure on the mechanical behavior were investigated.

U.S. Pat. No. 6,632,883, herein incorporated by reference in its entirety, discloses block copolymer compositions capable of being processed by the application of pressure. A method for predicting phase diagrams of polymer blends and block copolymers are also disclosed.

OBJECTS AND SUMMARY OF THE INVENTION

It is an object of the present invention to provide an improved method for the manufacture of cemented carbide or cermet agglomerates with good flow properties and good plasticity.

It is a further object of the present invention to provide a ready-to-press cemented carbide powder consisting of agglomerates with good flow properties and good plasticity.

In one aspect of the invention, there is provided a method of making a ready-to-press agglomerated powder mixture by wet milling a powder mixture containing a binder and spray drying said slurry to an agglomerated powder wherein the binder is a baroplastic polymer having a pressure induced transformation from hard to soft.

In another aspect of the invention, there is provided a powder containing a cemented carbide, cermet or ceramic powder mixture including a baroplastic polymer having a pressure induced transformation from hard to soft within a pressure range of from about 10 to about 50 MPa.

In a still further aspect of the invention, there is provided a slurry containing a cemented carbide, cermet or ceramic powder mixture containing a baroplastic polymer having a pressure induced transformation from hard to soft within a pressure range of from about 10 to about 50 MPa.

DETAILED DESCRIPTION OF THE PREFERRED EMBODIMENTS

Figure 1:
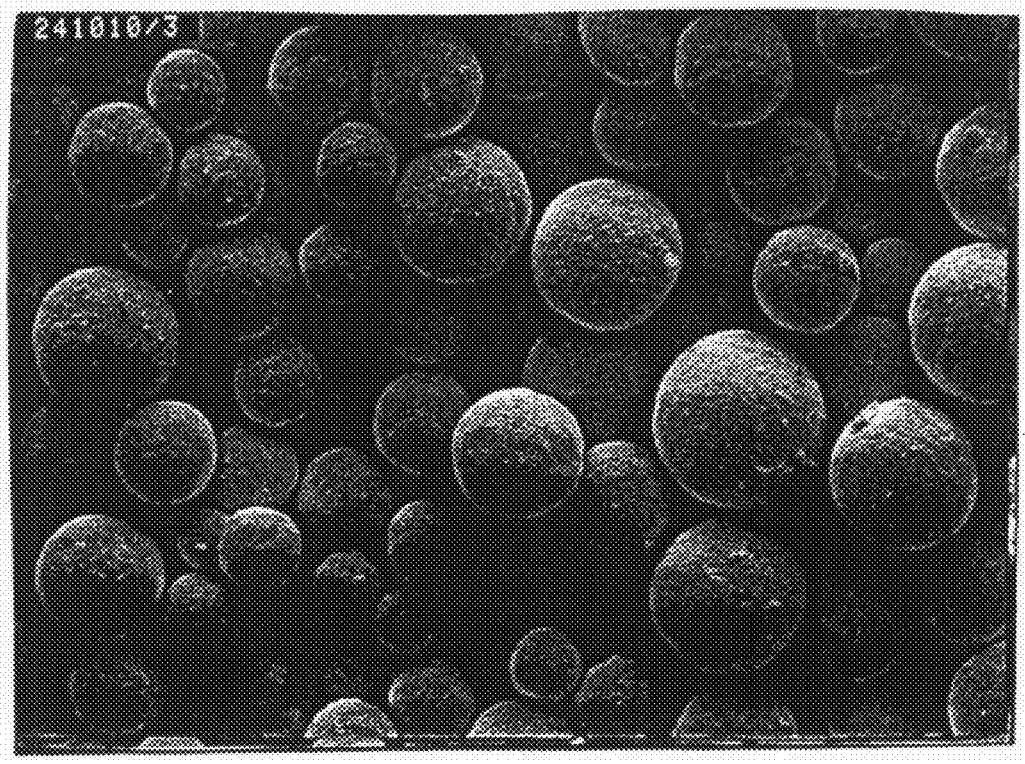
FIG. 1 is a SEM picture at 150 times magnification of spray dried granules of a powder produced according to the invention.

It has now surprisingly been found that a spray dried cemented carbide or cermet powder having well developed agglomerates with good flow properties and good plasticity can be obtained by using a baroplastic polymer as a binder.

The hard property of the binder is used at normal pressures, during handling of the spray-dried powder and in the green body, whereas the blended, softer properties are used at higher pressures during the pressing of the material when the pressure exceeds 10 MPa.

The baroplastic material is a block copolymer composition of a core-shell polymer consisting of particles with a core of a polymer with soft properties, and a shell of a polymer with hard properties with the size of the particles in the range of from about 50 to about 200 nm.

Preferably, the hard component of the polymer is polystyrene, poly(butyl methacrylate), poly(caprolactone), poly (ethyl methacrylate), poly(methyl methacrylate) or poly (hexyl methacrylate) and the soft component poly(butyl acrylate), poly(methyl acrylate), poly(ethyl acrylate), poly (ethylhexyl acrylate) or poly(caprolactone).

One aspect of the invention relates to a method of making an agglomerated ready-to-press powder mixture by wet milling a powder mixture containing the baroplastic binder and spray drying said slurry to form an agglomerated powder.

Preferably, the powder mixture is a cemented carbide, cermet or ceramic powder mixture and the pressure induced transformation from hard to soft takes place within a pressure range of from about 10 to about 50 MPa.

More preferably, the powder mixture contains hard constituent powder(s) based on carbides, nitrides and/or carbonitrides of Ti, Zr, Hf, V, Nb, Ta, Cr, Mo and/or W and from about 5 to about 15 wt-% metal binder phase powder(s) of Co and/or Ni as well as an agglomerating binder of a baroplastic polymer.

Another aspect of the invention relates to a an agglomerated powder containing hard constituent powder(s) based on carbides, nitrides and/or carbonitrides of Ti, Zr, Hf, V, Nb, Ta, Cr, Mo and/or W and metal binder phase powder(s) of Co and/or Ni. According to the invention, the agglomeration binder is a baroplastic polymer.

In another aspect, the invention relates to a slurry containing hard constituent powder(s) based on carbides, nitrides and/or carbonitrides of Ti, Zr, Hf, V, Nb, Ta, Cr, Mo and/or W and metal binder phase powder(s) of Co and/or Ni as well as binders. According to the invention, the agglomeration binder is a baroplastic polymer.

The invention has been described with reference to bodies of cemented carbide or cermets. It is obvious that the invention can generally be applied to the manufacture of bodies by powder metallurgical methods such as ceramics.

The invention is additionally illustrated in connection with the following examples, which are to be considered as illustrative of the present invention. It should be understood, however, that the invention is not limited to the specific details of the examples.

EXAMPLE 1

Figure 4:
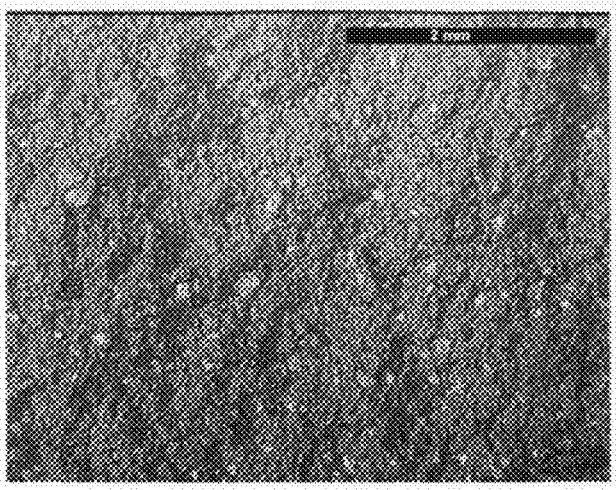
FIG. 4 is a picture of a surface of a broken green body produced according to the invention.

A cemented carbide ready to press powder was produced. First a slurry was produced based on 93 wt % WC, 5 wt % Co, 2 wt % baroplastic polymer as binder and 0.3 l/kg milling liquid. The baroplastic polymer was added as an emulsion of about 100 nm large particles which had a shell of polystyrene and a core of poly(2-ethylhexyl acrylate). The powder was milled to an average particle size of 3 μm. The slurry was dried according to standard practice resulting in an agglomerated powder mixture with well developed agglomerates shown in FIG. 1. The powder was pressed to bodies. A broken green body showed no residual agglomerate structure according to FIG. 4. The green body was sintered at 1410° C. in vacuum.

EXAMPLE 2

Figure 3:
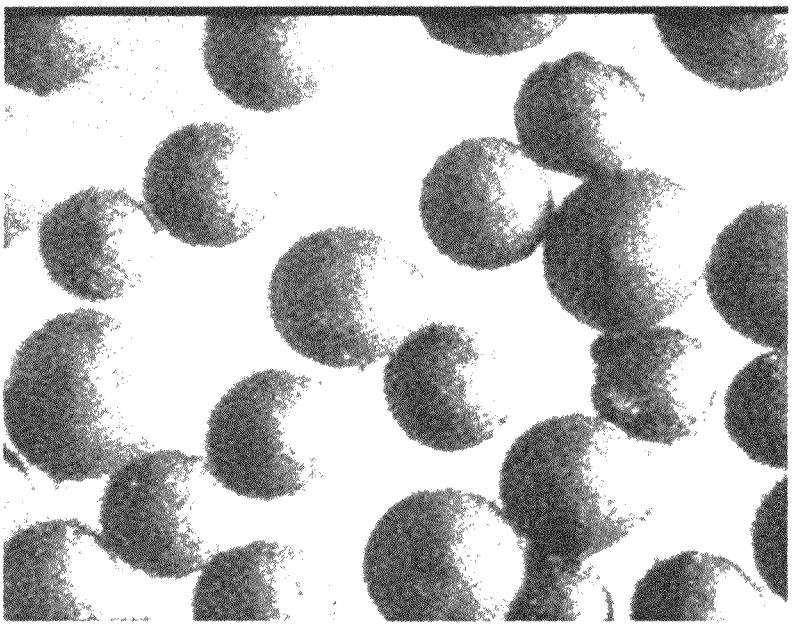
Figure 3 (PRIOR ART)
FIG. 3 is a SEM picture at 150 times magnification of spray dried granules of a powder produced according to prior art.
Figure 5:
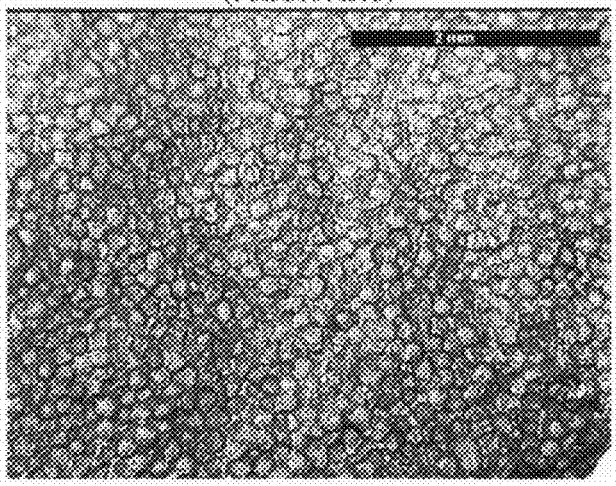
Figure 5 (PRIOR ART)
FIG. 5 is a picture of a surface of a broken green body produced according to prior art.

Example 1 was repeated with PEG 4000 as binder. The appearance of the agglomerates is shown in FIG. 3 and the structure of a broken green body in FIG. 5.

EXAMPLE 3

Figure 2:
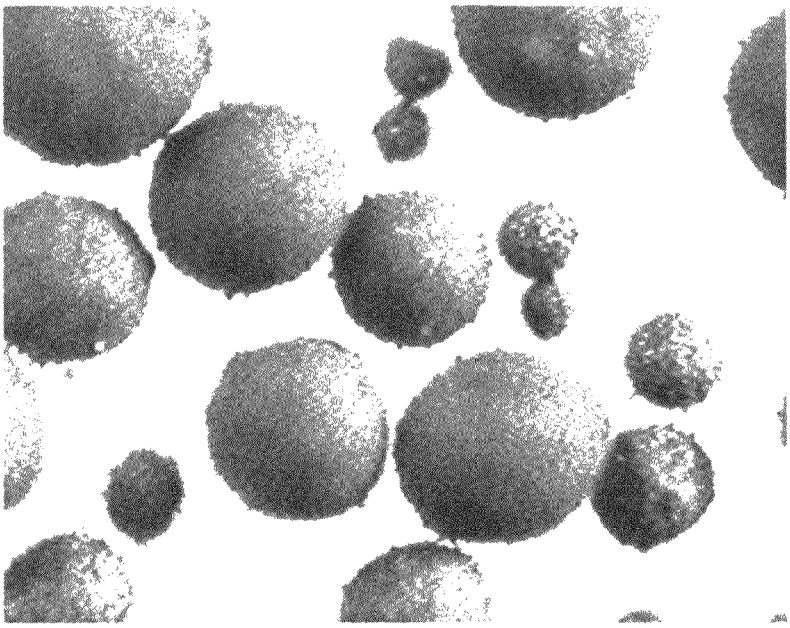
Figure 2 (PRIOR ART)
FIG. 2 is a SEM picture at 150 times magnification of spray dried granules of a powder produced according to prior art.
Figure 6:
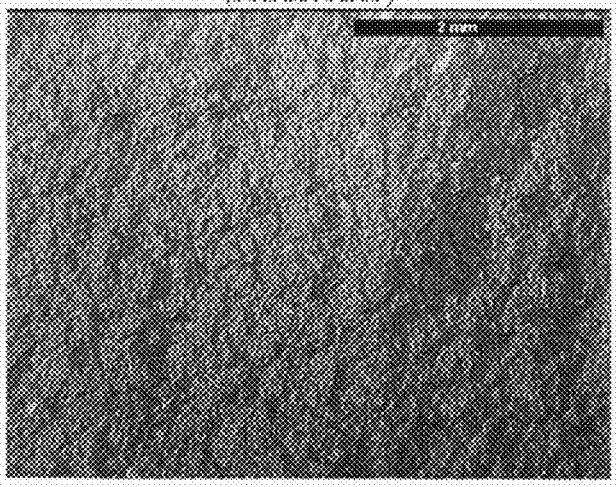
Figure 6 (PRIOR ART)
FIG. 6 is a picture of a surface of a broken green body produced according to prior art.

Example 1 was repeated with a mixture of 60% PEG 4000 and 40% PEG 300 as binder. The appearance of the agglomerates is shown in FIG. 2 and the structure of a broken green body in FIG. 6.

EXAMPLE 4

The powders from Examples 1, 2, and 3 were subjected to measurements of flow time according to ISO 4490. Porosity according to ISO 4505 was evaluated on polished cross sections of the sintered bodies. The following results were obtained.

| | Flow time | Porosity | | Pores 25-75 μm |
|---|---|---|---|---|
| | [S] | A | B | [Pores/cm$^2$] |
| Example 1 | 31 | 00 | 00 | 0 |
| Example 2 | 32 | 02 | 04 | 4 |
| Example 3 | 37 | 00 | 00 | 0 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Method of making a ready-to-press agglomerated powder mixture by wet milling a powder mixture containing a binder, a hard constituent powder and a metal binder phase powder, and spray drying said slurry to form an agglomerated powder, wherein the binder is a baroplastic polymer having a pressure induced transformation from hard to soft, wherein the hard constituent powder is based on a carbide, a nitride and/or a carbonitride of Ti, Zr, Hf, V, Nb, Ta, Cr, Mo and/or W and wherein the metal binder phase powder is Co and/or Ni, wherein the powder mixture includes from about 5 to about 15 wt-% metal binder phase powder.

2. A method of claim 1 wherein the powder mixture is a cemented carbide, cermet or ceramic powder mixture and that the pressure induced transformation from hard to soft takes place within a pressure range of from about 10 to about 50 MPa.

3. A method of claim 1 wherein the baroplastic polymer is a block copolymer composition of a core-shell polymer of particles with a core of a polymer with soft properties and a shell of a polymer with hard properties with the size of the particles being in the range of from about 50 to about 200 nm.

4. A method of claim 3 wherein the baroplastic polymer comprises:

a hard component where the polymer is polystyrene, poly (butyl methacrylate), poly(caprolactone), poly(ethyl methacrylate), poly(methyl methacrylate) or poly(hexyl methacrylate) and a soft component where the polymer is poly(butyl acrylate), poly(methyl acrylate), poly(ethyl acrylate), poly (ethylhexyl acrylate) or poly(caprolactone).

5. Powder containing a cemented carbide, cermet or ceramic powder mixture including a baroplastic polymer having a pressure induced transformation from hard to soft within a pressure range of from about 10 to about 50 Mpa, wherein the powder mixture includes a hard constituent powder based on a carbide, a nitride and/or a carbonitride of Ti, Zr, Hf, V, Nb, Ta, Cr, Mo and/or W and from about 5 to about 15 wt-% metal binder phase powder of Co and/or Ni.

6. A powder of claim 5 wherein the baroplastic polymer is a block copolymer composition of a core-shell polymer of particles with a core of a polymer with soft properties and a shell of a polymer with hard properties with the size of the particles in the range of from about 50 to about 200 nm.

7. A powder according to claim 6 wherein the baroplastic polymer comprises a hard component where the polymer is polystyrene, poly(butyl methacrylate), poly(caprolactone), poly(ethyl methacrylate), poly(methyl methacrylate) or poly (hexyl methacrylate) and a soft component where the polymer is poly(butyl acrylate), poly(methyl acrylate), poly(ethyl acrylate), poly(ethylhexyl acrylate) or poly(caprolactone).

8. Slurry containing a cemented carbide, cermet or ceramic powder mixture containing a baroplastic polymer having a pressure induced transformation from hard to soft within a pressure range of from about 10 to about 50 MPa, wherein the powder mixture includes a hard constituent powder based on a carbide, a nitride and/or a carbonitride of Ti, Zr, Hf, V, Nb, Ta, Cr, Mo and/or W and from about 5 to about 15 wt-% metal binder phase powder of Co and/or Ni.

9. A slurry of claim 8 wherein the baroplastic polymer is a block copolymer composition of a core-shell polymer of particles with a core of a polymer with soft properties and a shell of a polymer with hard properties with the size of the particles in the range of from about 50 to about 200 nm.

10. A slurry of claim 9 wherein the baroplastic polymer comprises a hard component where the polymer is polystyrene, poly(butyl methacrylate), poly(caprolactone), poly (ethyl methacrylate), poly(methyl methacrylate) or poly (hexyl methacrylate) and a soft component where the polymer is poly(butyl acrylate), poly(methyl acrylate), poly (ethyl acrylate), poly(ethylhexyl acrylate) or poly(caprolactone).

* * * * *